United States Patent [19]

Rudell et al.

[11] Patent Number: 4,739,985

[45] Date of Patent: Apr. 26, 1988

[54] POWER UNIT FOR ROPE JUMPING

[75] Inventors: Elliot Rudell, 2215 W. 237th. St., Torrance, Calif. 90501; George Foster, Long Beach; Joe Cernansky, Lomita, both of Calif.

[73] Assignee: Elliot A. Rudell, Torrance, Calif.

[21] Appl. No.: 909,914

[22] Filed: Sep. 22, 1986

[51] Int. Cl.[4] ..... A63B 5/20; A63B 5/22

[52] U.S. Cl. ..... 272/74; 272/75

[58] Field of Search ..... 272/74, 75; 248/74.2; 200/51.15

[56] References Cited

U.S. PATENT DOCUMENTS

| | | | |
|---|---|---|---|
| 1,978,499 | 10/1934 | Loveridge | 272/78 |
| 2,567,961 | 9/1951 | O'Brien et al. | 200/51.15 |
| 3,013,798 | 12/1961 | Willoughby | 272/74 |
| 3,136,543 | 6/1964 | Merl et al. | 272/74 X |
| 3,292,886 | 12/1966 | Rovinsky | 248/49 |
| 3,313,009 | 3/1965 | Beckerer | 248/74.2 |
| 3,481,600 | 12/1969 | Lang et al. | 272/74 X |
| 3,589,718 | 6/1971 | Bessler | 272/74 |
| 3,610,616 | 10/1971 | Evans | 272/75 |
| 3,612,522 | 10/1971 | Ekonen | 272/75 |
| 4,018,441 | 4/1977 | Greenberg | 272/75 |
| 4,082,266 | 4/1978 | Elkins | 272/75 |
| 4,192,501 | 3/1980 | Peoples | 272/75 |
| 4,634,127 | 1/1987 | Rockwell | 272/134 |

FOREIGN PATENT DOCUMENTS

| | | | |
|---|---|---|---|
| 1400005 | 7/1975 | United Kingdom | 272/74 |

OTHER PUBLICATIONS

Popular Mechanics Magazine, vol. 116, No. 2, 7-1961, p. 72, "Toy Keeps Them Jumping".

*Primary Examiner*—Richard J. Apley
*Assistant Examiner*—David J. Bender
*Attorney, Agent, or Firm*—Plante, Strauss & Vanderburgh

[57] ABSTRACT

There is disclosed a power unit for twirling a jump rope about a substantially horizontal axis, as in conventional rope jumping, or about a vertical axis to provide an entirely new variation of the game. The power unit includes a stand with a vertical standard which supports a motorized drive with an output shaft on which is mounted a crank element. One end of a jump rope is attached to the crank element, which twirls the jump rope. The opposite end of the jump rope is secured to a stationary support, e.g., fence post, side of a building, etc. The power unit can also be removed from the vertical standard and seated in a recess in the base of the stand with the drive shaft vertically oriented, whereby the crank element is rotationally driven about a vertical axis. A short rope is secured to the crank element and a weighted element such as a foam plastic ball is secured to its free end. The players jump the rope as it swung around in a horizontal arc of rotation, thereby providing a new variation of the game.

23 Claims, 5 Drawing Sheets

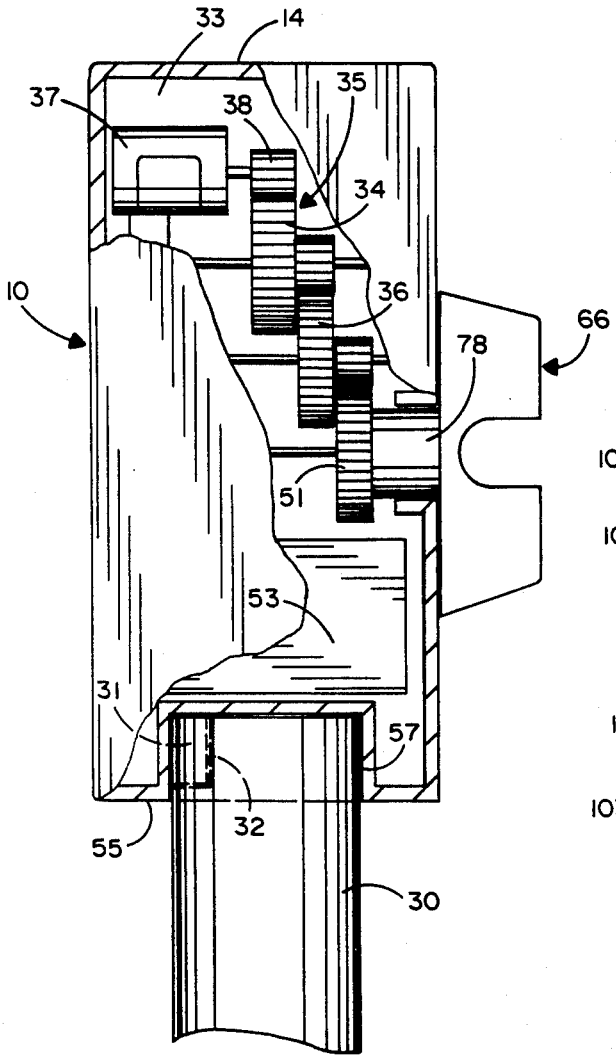
FIG. 8
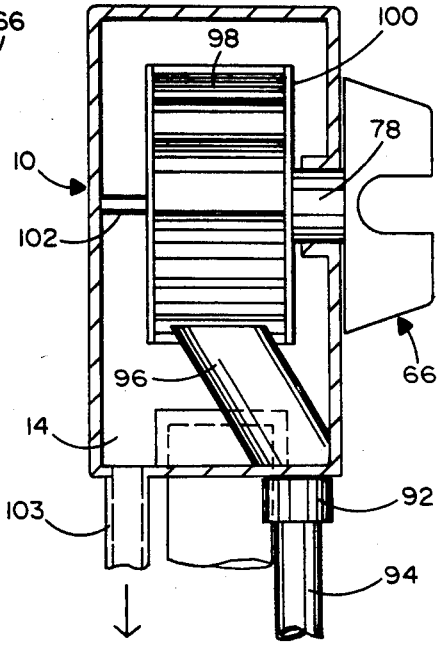
FIG. 9
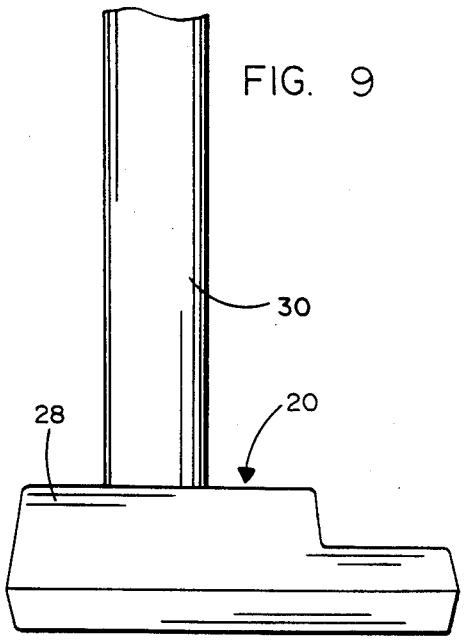

POWER UNIT FOR ROPE JUMPING

BACKGROUND OF THE INVENTION

1. Field of the Invention

This invention relates to rope jumping and in particular to a self-contained power unit for twirling the rope for rope jumping, and to a new variant of that game.

2. Brief Statement of the Prior Art

Rope jumping has been universally enjoyed by children for decades. The least enjoyable task, when a group of children jump rope, is that of twirling the rope while others jump. This task usually requires two children, who are thus only passively involved in the play, while the other children actively enjoy the game, and engage in maneuvers such as jumping in and out, touching the ground, etc.

Although one person can jump rope, the requirement that the jumper twirl the rope limits the maneuvers by that person and prevents maneuvers and body movements which can only be practiced when the rope jumper's arms are free.

Additionally, although rope jumping has been a child's game for many years and is used for conditioning of athletes, that sport has essentially been limited to twirling a rope over the jumper's head, thus requiring substantial vertical clearance and usually prohibiting rope jumping indoors. Accordingly, there exists a need for a variation of the rope jumping game without the need to twirl a jump rope over the jumper's head. This would permit a jump rope over the jumper's head. This would permit rope jumping indoors, e.g., during inclement weather, or for body fitness application in the home.

BRIEF DESCRIPTION OF THE INVENTION

This invention comprises a power unit for twirling a jump rope about a substantially horizontal axis, as in conventional rope jumping, or about a vertical axis to provide an entirely new variation of the game. The power unit includes a pedestal stand, preferably with a weighted pedestal base, which supports a motorized drive that includes a drive motor, a drive train with an output shaft on which is mounted a crank element. The crank element has an attachment means to secure one end of the jump rope eccentric to the drive shaft, thus providing a crank arm to twirl a conventional jump rope. The weighted pedestal base also supports a vertical standard which supports the power unit above the ground the necessary distance for ground clearance for the jump rope, when the unit is used for the conventional rope jumping, in which the output shaft is horizontal. One end of a jump rope is attached to the crank element, and the opposite end of the jump rope is secured to a stationary support, e.g., fence post, side of a building, etc.

The power unit can also be disassembled from the vertical standard and seated in a recess in the pedestal base with the drive shaft vertically oriented, whereby the crank element is rotationally driven about a vertical axis. A short rope is secured to the crank element and a weighted element such as a foam plastic ball is secured to its free end. The players jump the rope as it is swung around in a horizontal arc of rotation, thereby providing a new variation of the game.

Power, preferably electrical power, is supplied to the power unit. Most preferably, rechargeable storage batteries are included in the housing of the power unit.

Alternate power sources are also disclosed. The power has an on/off switch and, preferably, has a speed control switch whereby the jumpers can select any of several predetermined speeds of rotation of the jump rope.

BRIEF DESCRIPTION OF THE DRAWINGS

The invention will be described with reference to the figures of which:

FIG. 8 is a sectional view through the power unit;

FIG. 9 is a sectional elevational view of a power unit for operation with water pressure;

DESCRIPTION OF PREFERRED EMBODIMENT

Figure 1:
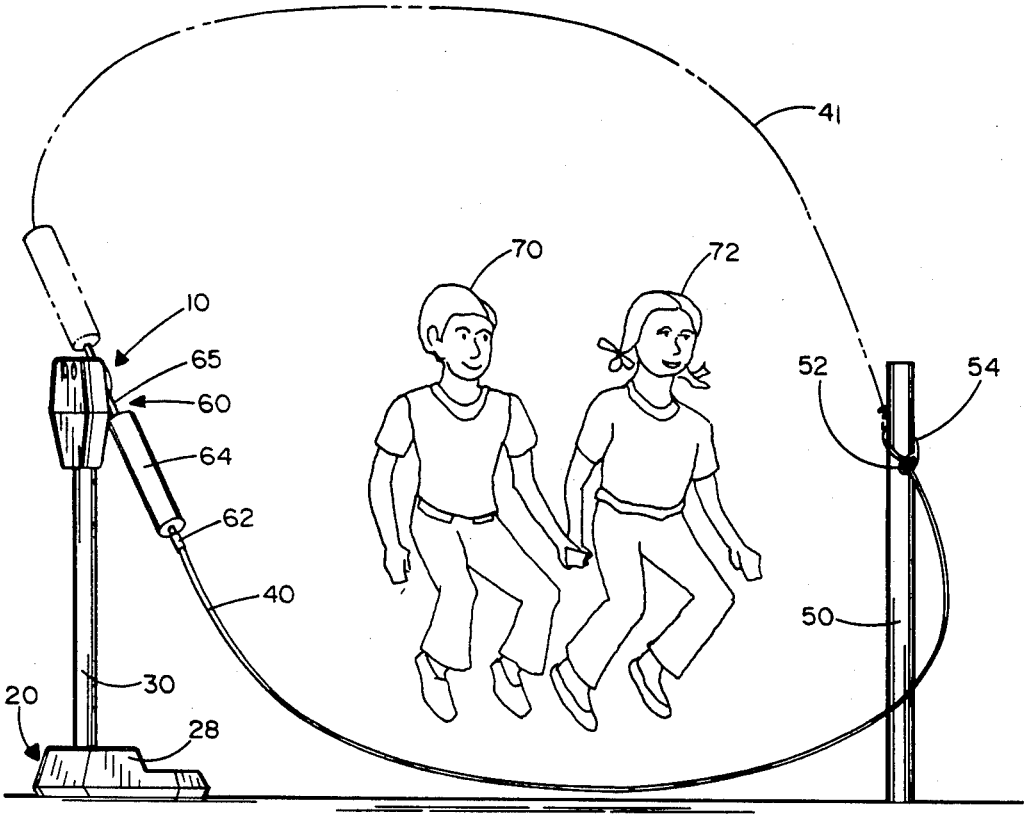
FIG. 1 illustrates children jumping rope with the power unit of the invention driving the jumping element in a conventional manner.

Referring now to FIG. 1, the power unit 10 of the invention is illustrated as it is applied to conventional rope jumping. As there illustrated, the power unit 10 is shown mounted on a pedestal stand 20 having a pedestal 28 and a vertical standard 30 that supports the power unit at a sufficient elevation to provide ground clearance for the jumping element 40. The jumping element can be a conventional, flexible jump rope, or it can be a semi-rigid element with a preformed bight, e.g., a plastic tube. At its opposite end, the jumping element 40 is secured to a stationary support such as a vertical post 50 and, for this purpose, the end of the jumping element can have an eyelet 52 through which the jumping element 40 is passed, thereby forming a loop 54 that can be secured about the vertical post 50. Alternatively, a plate with an eyelet can be provided for attachment to any elevated surface. The opposite end of the jumping element 40 is secured to the crank element 60 by releasable attachment 62. The crank element 60 has a crank arm 65 which is preferably covered with a soft sleeve 64, such as a sleeve formed of a closed cell, compressible plastic foam.

In use, the power unit 10 rotates the crank element 60 about a horizontal axis, thereby twirling jumping element 40 which is shown at its opposite maximum excursions by the solid lines, and by phantom lines 41. One or several jumpers 70 and 72 can then jump rope in a conventional manner, without the necessity of having other players twirl the jumping element 40.

Figure 2:
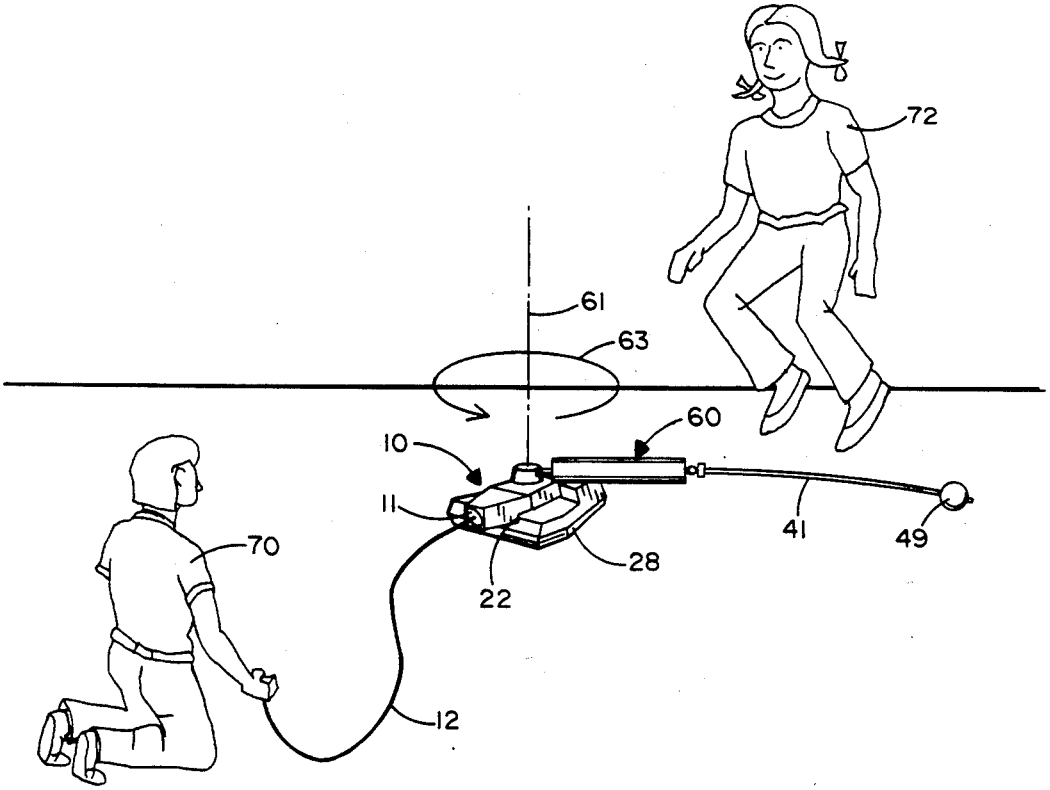
FIG. 2 illustrates the power unit used in a variation of rope jumping in which a jumping element is twirled about a vertical axis.

Referring now to FIG. 2, a variant of the conventional rope jumping game is illustrated. In this application, the power unit 10 is mounted in a recess 22 in the pedestal base 28 of the pedestal stand 20. The vertical standard 30 (as illustrated in FIG. 1) is not used in this embodiment. In this position, the crank element 60 is mounted for rotation about a vertical axis shown at 61. A short jumping element 41 is secured to the end of the crank element 60, and this element can be a flexible rope or can be a stiff or flexible wand. Preferably a flexible rope is used and a weight 49, such as a foam ball, is attached to its outer end. In the application shown in FIG. 2, a tether cord 12 is attached to the on/off control 11 of the power unit 10 so that a player, such as 70, can turn the power unit 10 on and off. When the power unit is turned on, it rotates the crank element 60 about vertical axis 61 as shown by arrowhead line 63 and a jumper such as 72 jumps with each revolution of the rope. Many jumpers can participate, forming a circle about the power unit 10. As apparent from FIG. 2, this application of the invention provides all the fun and excitement of rope jumping and presents entirely new possibilities for the game. Also. FIG. 2 illustrates that this application does not require any substantial overhead clearance for the rope, thus permitting indoor use in rooms with conventional ceilings.

Figure 3:
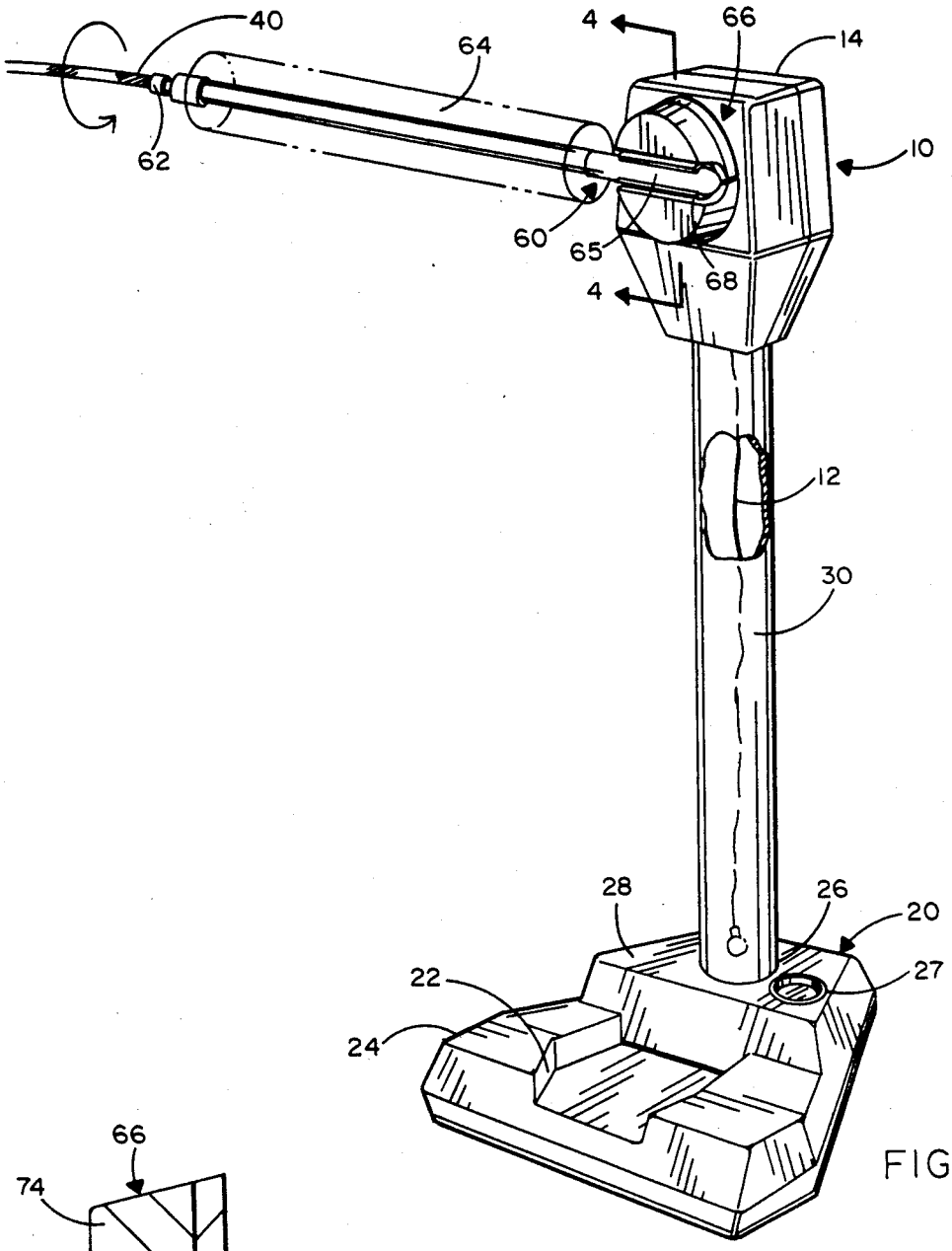
FIG. 3 is a perspective view of the power unit.
Figure 4:
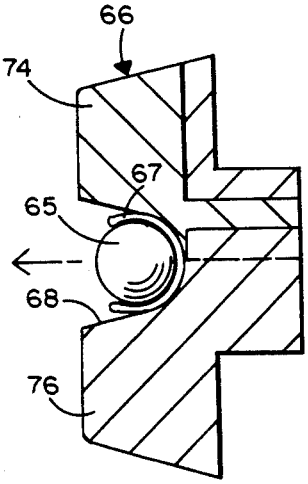
FIG. 4 is a sectional view of the crank element of the invention.

Referring now to FIG. 3, the power unit 10 and pedestal stand 20 of the invention will be described in greater detail. As shown in FIG. 3, the power unit 10 has a housing 14 which contains the drive train 35 (as illustrated in FIGS. 8 and 9). unit. The crank element 60 has a crank hub 66 which is supported on a horizontal power shaft (not shown) of the drive train 35. The crank hub 66 has a cross slot 68 which receives the end of the crank arm 65. Preferably, the crank arm 65 is yieldingly restrained in cross slot 68 and, for this purpose, the cross slot 68 is provided with one or more U-shaped brackets 67 (as shown in FIG. 4), which grasp the crank arm 65. The construction of the crank arm 65 and its restraint in the crank hub 66 is shown ing reater detail by FIGS. 4 and 5.

FIG. 4 is a sectional view along line 4–4' of FIG. 3. The crank arm 65 is shown as restrained by the U-shaped bracket 67 which is mounted in cross slot 68 of the crank hub 66. As illustrated, the U-shaped bracket 67 has an arcuate bight and extends slightly beyond 180 degrees to provide thereby a yielding detent for the cylindrical crank arm 65. As illustrated in FIG. 4, the crank hub 66 is formed with a first hub element 76. The shape and assembly of these hub elements is shown in FIG. 5.

Figure 5:
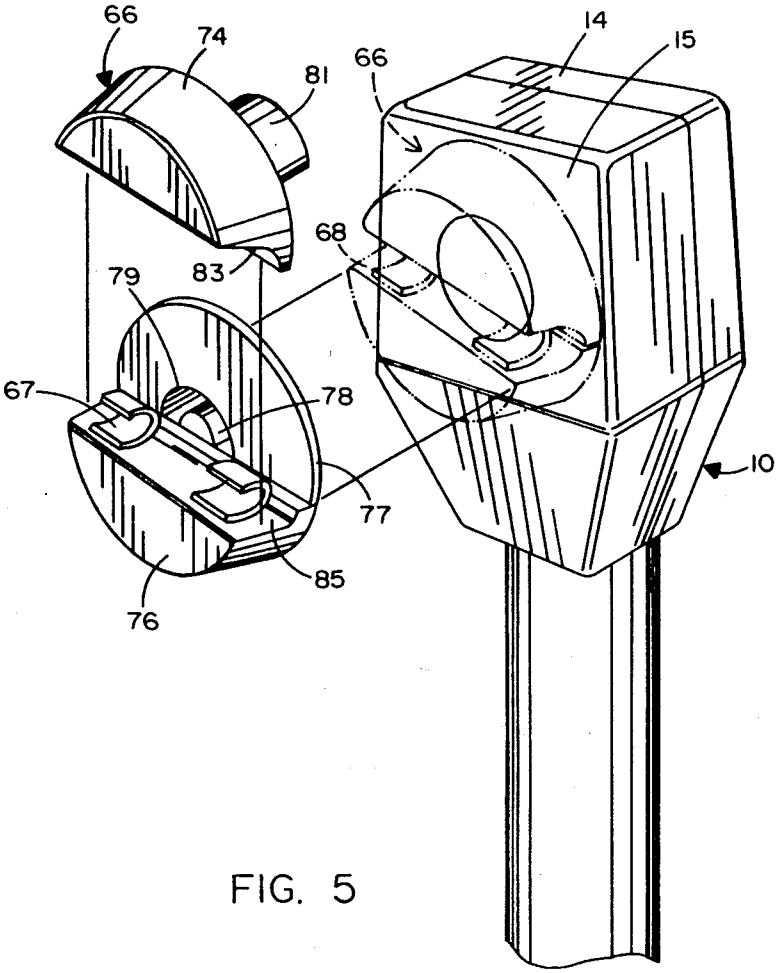
FIG. 5 is a perspective view of the power unit, with an exploded view of the crank hub of the crank element.

Referring now to FIG. 5, the crank hub 66 is shown in exploded view by solid lines and in assembled view in phantom lines. The U-shaped brackets 67 are permanently attached to the second hub element 76, which has a circular end flange 77 and supports the output shaft 78 of the power unit 10. The end flange 77 has a semicircular slot 798 which receives the split cylindrical boss 81 of the first hub element 74. Each of the hub elements 74 and 76 has an arcuate groove, 83 and 85, respectively, which together form the cross slot 68.

The crank hub 66 is shown in assembly by the phantom line illustration of FIG. 5. This crank hub 66 mounted on the forward face 15 of the housing 14 of the power unit 10, with the output shaft 78 extending to the drive train 35 (as shown in FIGS. 8 AND 9) within housing 14.

Figure 6:
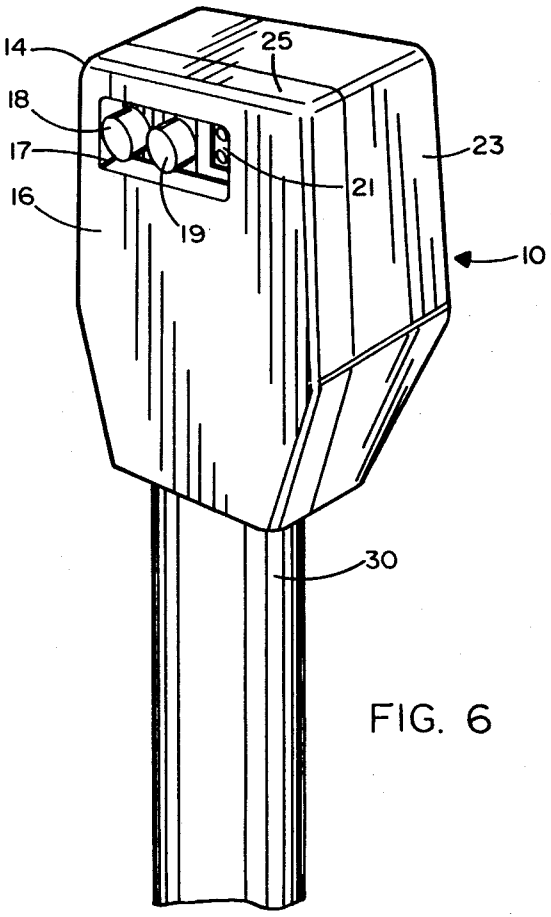
FIG. 6 is a perspective view of the back of the power unit.

Referring now to FIG. 6, the power unit 10 is provided with operational controls and these controls are mounted on the back panel 16 of the housing 14. For this purpose, the back panel 16 can have a recessed area 17 for a control panel which includes an on/off switch 18 and a speed control knob 19. The control panel preferably also has connector 21 for attachment of an electrical cord which supplies electrical power to the unit for operation or for recharging the rechargeable batteries that are preferably contained within housing 14.

The housing 14 is preferably formed of two half shells 23 and 25 which also provide a recess on the undersurface of the housing 14 to permit the housing 14 to be mounted on the vertical standard 30 of the pedestal stand 20.

Referring again to FIG. 3, the vertical standard 30 is preferably tubular to provide an interior recess whcih can receive the tether cord 12 of the power unit 10, thereby storing this cord when the power unit 10 is used in its configuration illustrated in FIG. 3.

The pedestal base 28 for the invention is preferably of hollow form, polygonal shape. The forward portion 24 of the pedestal base 28 has a recess 22 which has the shape of the exterior dimension of housing 14, thereby providing a recess to receive the housing 14 in its horizontal position, as shown in FIG. 2. The recess 22 includes means to restrain the housing 14, which peferably is sized to provide a snug, or frictional, fit for the housing 14. Alternatively, a rib and groove detent, or spring biased detents can be used to restrain the housing 14 in recess 22.

Preferably, the pedestal base 28 has a through aperture in one of its horizontal upper surfaces which is closed by a removable cap 27. Ths permits one to fill the pedestal base 28 with sand, water or other weighted material.

The pedestal base 28 has a socket 26 or through aperture that removably receives the vertical standard 30. When the power unit 10 is configured as shown in FIG. 2, the vertical standard 30 is removed from the power unit 10.

Figure 7:
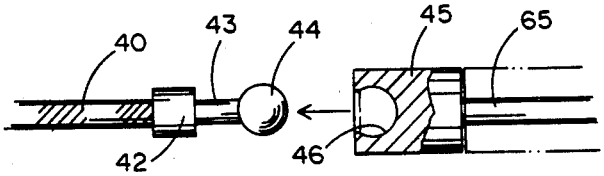
FIG. 7 is partial section view of the jumping element attachment to the crank element.

As illustrated in FIG. 1, the jumping element 40, such as a jump rope, is secured to the crank element 60 by a releasable attachment 62. FIG. 7 illustrates the releasable attachment 62. For this purpose, the end of the jmmping element 40 is permanently received in a ferrule 42 which is compressed about the end of the jumping element and which has a short shaft 43 and a distal ball 44. The crank arm 65 distally supports a socket member 45 which has a spherical socket 46 to yieldingly receive the distal ball 44. The jumping element 40 is retained by crank arm 65 with distal ball 44 freely rotational in socket 46, thereby permitting the jumping element 40 to swivel in crank arm 65, thus avoiding twisting of the jumping element 40.

The yielding restraint of the crank arm 65 in crank hub 66, previously described with reference to FIGS. 3 and 4, and the yielding restraint of the jumping element 40 in the socket member 45 on the crank arm 65, provide very important safety features for the invention. In the event that the crank arm 65 strikes a jumper or encounters an obstruction, it will be dislodged from the crank hub 66 before any injury or damage can occur. Similarly, in the event that the jumping element 40 should become entangled with a jumper or an obstruction, the distal ball 44 carried on the jumping element 40 will pop out of its detenting restraint in the socket member 45 before any injury or damage will result.

Referring now to FIG. 8, the construction of the power unit 10 is shown in greater detail. As there illustrated, the housing 14 has an interior chamber 33 in which is mounted the drive train 35 and the drive motor 37. The drive train 35 includes compound gears 34 and 36 which are engaged, respectively, by the drive sprocket gear 38 and the gear 51 on the output shaft 78 of the unit. This use of compound gears in the drive train 35 provides a significant lever advantage to the drive motor 37 and permits use of a drive motor 37 of relatively low power demand.

The housing 14 also contains, within the interior chamber 33, a rechargeable storage batter 53 which can be a conventional battery of long life and rechargeable characteristics. The base 55 of the housing 14 has a recess 57 to receive the upper end of the vertical standard 30. Preferably the recess 57 and vertical standard 30 are indexed together to prevent rotation of the vertical standard 30 in the assembly. Various indexing means can be used; a key 31 on the internal sidewall of recess 57, whichf its into a slot 32 in the end of the vertical standard 30, is shown. Alternatively, vertical standard 30 and its mating recess 57 could be formed with non-circular cross sections. The vertical standard 30 could also be received in a snug, friction fit in recess 57 to readily permit disassembly of the power unit 10 from the supporting vertical standard 30. A similar or identical indexing means can be provided between the lower end of vertical standard 30 and the socket 26 in the pedestal base 28.

Alternate power sources can be used for the power unit 10. FIG. 9 illustrates an alternate power means in which the power unit 10 is provided with a standard sleeved hose connector 92 having internal threads for the attachment of a garden hose 94. The hose connector 92 communicates with a fluid nozzle 96 which is directed to discharge a jet of water against the impeller blades 98 of a water turbine 100 that is rotatably mounted on a support shaft 102 and that is coupled to the output shaft 78. The housing 14 is provided with a drain 102 to permit the water to drain from the housing. As with the previously described embodiments, the power unit 10 of this embodiment can also be removed from the vertical standard 30 and placed in a horizontal position on the pedestal base 28 to provide the configuration for twirling a jumping element about a vertical axis, such as shown in FIG. 2.

Figure 10:
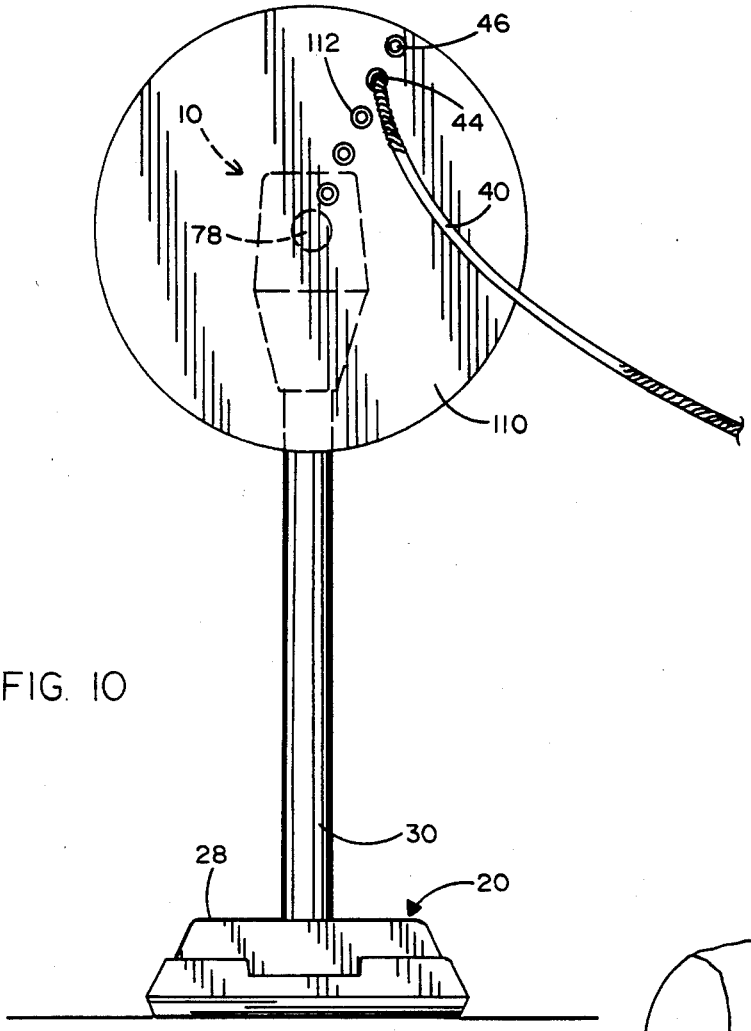
FIG. 10 illustrates an alternative crank element for use on the invention.

Referring now to FIG. 10, the power unit 10 is shown with an alternate crank element, disk 110, which is mounted on the output shaft 78. The disk 110 provides the additional safety feature of avoiding a crank arm 65. The disk 110 also can be provided with a plurality of bosses 112 which are positioned eccentric to output shaft 78 and which have sockets such as 46 to receive the distal ball 44 of the jumping element 40. For this purpose, a distal ball and socket attachment means similar to that shown in FIG. 7 can be employed.

Figure 11:
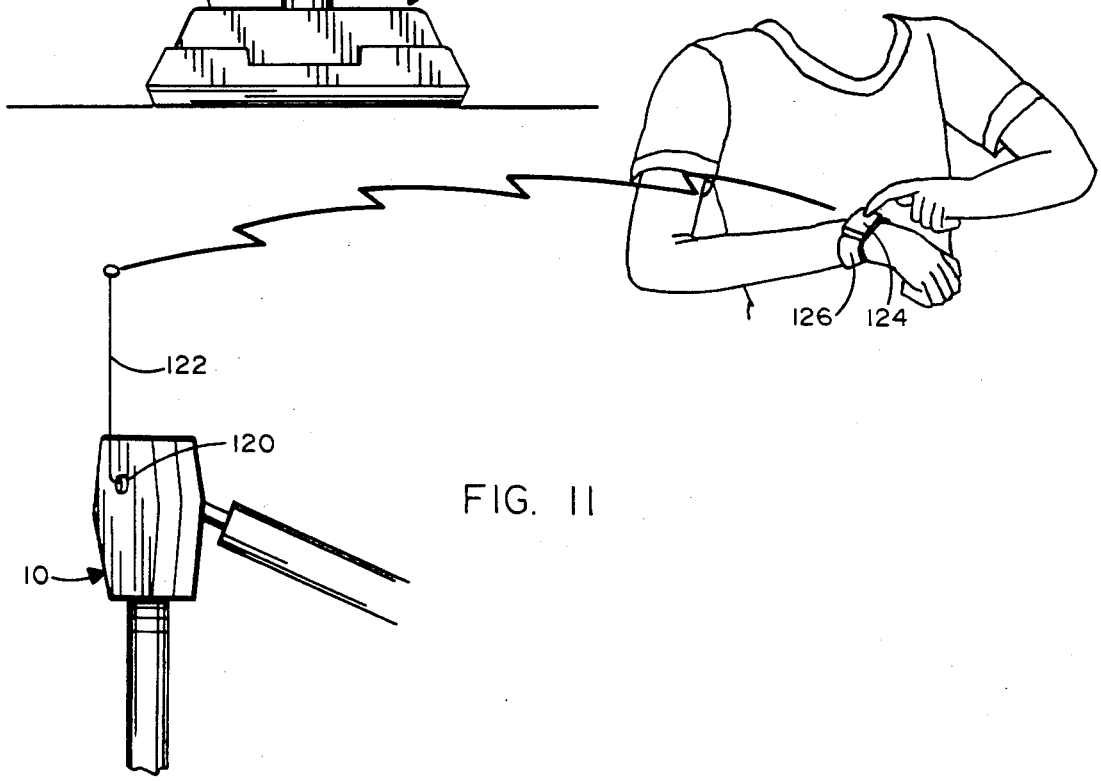
FIG. 11 illustrates a remote control used with the invention.

As shown in FIG. 11, the power unit 10 can be provided with a suitable remote control means to control the operation of the power unit 10. For this purpose, a radio signal, or infrared beam control unit 120 can be placed on the power unit 10 with an antenna 122, if necessary. One or more of the participants can wear a radio signal or infrared beam transmitter 124. In this application. a simple wrist band 126 can be used to attach the radio signal or infrared beam transmitter 124, thereby permitting the jumper to control the on/off switch and revoltuion speed of the power unit 10.

The invention has been described with reference to the illustrated and presently preferred embodiments. It is not intended that this invention be unduly limited by this disclosure of the presently preferred embodiment. Instead, it is intended that the invention be defined by the means, and their obvious equivalents, set forth in the following claims.

What is claimed is:

1. A power unit for twirling a jumping element which comprises:

a. a pedestal stand;

b. a power unit housing supported at the upper end of said pedestal stand;

c. a power unit having a drive motor received within said power unit housing, and an output shaft mechanically coupled to said drive motor and mounted on said housing for rotation on a horizontal axis with said housing supported on the upper end of said pedestal stand;

d. a crank element comprising a central hub having a transverse slot mounted on said output shaft of said power unit exteriorly of said housing, a crank arm having a laterally extending arm yieldingly mounted in the transverse slot of said hub by means permitting the substantially instantaneous detachment of said crank arm upon impact; and e. attachment means to secure a jumping element to the laterally outward end of said crank arm.

2. The power unit of claim 1 including at least one U-shaped bracket which is mounted within said transverse slot and which has a pair of outwardly facing spring arms to receive the end of said crank arm opposite said laterally outward end.

3. The power unit of claim 1 including a sleeve received over said crank arm and coextensive the length thereof, and formed of a soft, closed cell, compressible foam.

4. The power unit of claim 1 including a jumping element removably attached to an eccentric position on said crank element.

5. The power unit of claim 4 wherein said jumping element distally supports a ball detent, and said crank element supports a coacting socket member which yieldingly and rotationally receives said ball detent.

6. The power unit of claim 1 wherein said crank element is a disc mounted on said shaft with said attachment means located eccentrically thereon.

7. The power unit of claim 6 wherein said attachment means comprises a ball detent distally carried on said jumping element, and at least one coacting socket member eccentrically mounted on said disc and yieldingly and rotationally receiving said ball detent.

8. The power unit of claim 1 wherein said power unit is removably received on the upper end of said vertical standard.

9. The power unit of claim 1 wherein said vertical standard is removably received in said pedestal base.

10. The power unit of claim 1 having remote control means including a remote control transmitter, and a control receiver mounted on said power unit, and operable to control said drive motor.

11. The power unit of claim 1 including a turbine mounted for rotation within the housing of said power unit and mechanically coupled to said output shaft, with means to direct a fluid stream against the blades of said turbine, thereby rotationally driving said output shaft.

12. The power unit of claim 11 wherein said means to direct a fluid stream comprises a water hose coupling on said housing, and a water nozzle positioned in said housing to discharge a jet of water against said turbine blades.

13. The power unit of claim 1 including an electrical drive motor with an electrical power supply and on/off power control switches in circuit between said power supply and said drive motor.

14. A power unit for twirling a jumping element which comprises:

a. a pedestal stand having a vertical standard mounted on a pedestal base;

b. a power unit having a housing removably received on the upper end of said vertical standard and containing a power unit having a drive motor and output shaft;

c. a crank element mounted on said output shaft of said power unit and mechanically coupled to said power unit;

d. attachment means to secure a jumping element to an eccentric position on said crank element; and e. a horizontal recess in said pedestal base conforming to the exterior dimensions of said housing to removably receive said power unit with said crank element oriented for rotation about a vertical axis.

15. The power unit of claim 14 including a jumping element attached to said crank element.

16. The power unit of claim 15 wherein said jumping element is flexible and distally carries a weight.

17. The power unit of claim 14 including an electrical drive motor with an electrical power supply and on/off power control switches in circuit between said power supply and said drive motor.

18. The power unit of claim 16 including a tether cord attached to said on/off switch and extending from the end of said housing received over the upper end of said vertical standard, whereby said tether cord may be stored in said vertical standard when said housing is supported on the upper end of said vertical standard.

19. The power unit of claim 17 including a tether cord attached to one of said on/off switches.

20. A power unit for a jumping game for players to jump a jumping element rotating in a horizontal plane, which comprises:

a. a power unit having a housing for resting on a floor and including an electrical drive motor with an output shaft and an electrical power supply and on/off power control switches in circuit between said power supply and said drive motor mounted within said housing;

b. a rotationally driven crank element for rotation about a vertical axis; and having a central hub having a transverse slot mounted on said output shaft of said power unit exteriorly of said housing, and a crank arm yieldingly mounted in the transverse slot of said hub by means permitting the substantially instantaneous detachment of said arm upon impact, and having a laterally extending arm;

c. a jump rope which distally supports a weight and, at its opposite end, being attached to said extending arm to be swung in a horizontal arc by said power unit, whereby players can position themselves around said power unit and jump over the jump rope as it rotates; and d. a tether cord with one end thereof attached to one of said on/off switches within said housing and having a length greater than that of said crank element and said jump rope so that the opposite end thereof can be extended beyond the circle of rotation of said jump rope.

21. The power unit of claim 20 wherein said jump rope supports a weight at one end.

22. The game of claim 21 wherein said weight is a ball formed of closed cell compressible foam.

23. The power unit of claim 20 including at least one U-shaped bracket which is mounted within said transverse slot and which has a pair of outwardly facing spring arms to receive the end of said crank arm opposite said laterally outward end.

* * * * *

UNITED STATES PATENT AND TRADEMARK OFFICE

CERTIFICATE OF CORRECTION

PATENT NO. : 4,739,985

DATED : April 26, 1988

INVENTOR(S) : Elliot A. Rudell

It is certified that error appears in the above—identified patent and that said Letters Patent is hereby corrected as shown below:

Claim 22, line 29, change "game" to --power unit--

Signed and Sealed this

Twenty-first Day of February, 1989

*Attest:*

DONALD J. QUIGG

*Attesting Officer*

*Commissioner of Patents and Trademarks*